United States Patent [19]

Agbay et al.

[11] Patent Number: 5,027,624

[45] Date of Patent: Jul. 2, 1991

[54] BARREL LOCK WITH BAFFLE WASHER AND KEY THEREFOR

[75] Inventors: Anthony J. Agbay, Auburn; John H. Carlson, West Boylston, both of Mass.

[73] Assignee: Olson Manufacturing Company, Holden, Mass.

[21] Appl. No.: 902,073

[22] Filed: Aug. 27, 1986

Related U.S. Application Data

[63] Continuation of Ser. No. 595,418, Mar. 30, 1984, abandoned.

[51] Int. Cl.[5] ..... E05B 67/36

[52] U.S. Cl. ..... 70/34; 70/386

[58] Field of Search ..... 70/34, 386, 395, 14, 70/23, 32, 33, 38 C

[56] References Cited

U.S. PATENT DOCUMENTS

| | | | |
|---|---|---|---|
| 1,923,025 | 8/1933 | Morse et al. | 70/34 |
| 3,033,016 | 5/1962 | Moberg | 70/34 |
| 3,714,802 | 2/1973 | Morse et al. | 70/34 |
| 3,785,670 | 1/1974 | Smith | 70/34 |
| 4,015,456 | 4/1977 | Moberg | 70/395 |
| 4,040,279 | 8/1977 | Signorelli et al. | 70/34 |
| 4,058,992 | 11/1977 | Nielsen | 70/386 |
| 4,063,434 | 12/1977 | Moberg | 70/386 |
| 4,155,232 | 5/1979 | Haus, Jr. et al. | 70/34 |
| 4,289,000 | 9/1981 | Nielsen | 70/34 |
| 4,313,319 | 2/1982 | Haus et al. | 70/34 |
| 4,394,820 | 7/1983 | Swisher | 70/34 |
| 4,513,591 | 4/1985 | Carlson et al. | 70/34 |
| 4,543,807 | 10/1985 | Swisher | 70/34 |

*Primary Examiner*—Vinh T. Luong

*Attorney, Agent, or Firm*—Samuels, Gauthier & Stevens

[57] ABSTRACT

A barrel lock and a key for locking and unlocking the barrel lock. The lock has a hollow barrel with a spring loaded plunger that reciprocates within the bore of the barrel. A recess is provided in an axial blind bore formed in the rear end of the plunger, the recess defining a gripping surface for unlocking the barrel lock. A spring loaded baffle washer having a key central aperture is positioned within the barrel bore rearwardly of the plunger. The baffle washer limits access to the plunger and prevents unauthorized unlocking of the barrel lock.

The key has elongated outer expanding fingers and an inner coaxially arranged expander rod. The expanding fingers are sized and shaped so that they can pass entirely through the key central aperture of the baffle washer. When the key is fully inserted into the lock and the key handle is operated, the expanding fingers radially expand and press against the gripping surface in the blind bore. As the handle is operated further, the expanding fingers longitudinally retract to draw the plunger rearwardly permitting the lock to unlock. If an unauthorized key or nail is inserted into the barrel lock, the plunger spring holds the plunger in its forward locking position as the unauthorized key or nail pulls the baffle washer rearwardly, preventing the lock from unlocking.

4 Claims, 3 Drawing Sheets

BARREL LOCK WITH BAFFLE WASHER AND KEY THEREFOR

BACKGROUND OF THE INVENTION

This is a continuation of application Ser. No. 595,418, filed Mar. 30, 1984, and now abandoned.

Prior art barrel locks and keys are shown in U.S. Pat. Nos. 1,923,025; 3,002,368; 3,835,674; and 4,289,000. The disclosures of these patents are incorporated by reference and made a part of the present disclosure. These prior art locks and keys have become increasingly less secure with the passage of time because of the relatively wide, albeit substantially controlled, distribution and use of the keys by a large number of people.

It is the object of this invention to provide a barrel lock which cannot be opened with a conventional key or with picks or nails.

It is also the object of this invention to provide a barrel lock key which is uniquely designed to open the aforesaid barrel lock.

SUMMARY OF THE INVENTION

The barrel lock of this invention has a hollow barrel with a plunger having an axial blind bore, the plunger reciprocating within the barrel. A baffle washer having a key central aperture is positioned within the barrel bore between a baffle compression spring and a plunger compression spring. The baffl e washer is urged forwardly by the baffle compression spring and the plunger is urged forwardly by the plunger compression spring. A coaxial recess in the blind bore defines a gripping surface for retracting the plunger.

The key of this invention is specifically designed to open the barrel lock of this invention. It is somewhat similar to the prior art keys. However, the key has an expander rod and fingers which are sized and shaped to fit the key aperture in the baffle washer. The fingers are sized and shaped to grip the recess in the blind bore when the key handle is operated. When the key is fully inserted into the barrel lock, the expanding fingers pass through the baffle washer and are positioned adjacent the recess in the lock plunger. When the key handle is operated, the fingers spread radially and press against the inner gripping surface of the recess. Further operation of the key handle retracts the lock plunger and permits the locking balls in the lock to move radially inward to their unlocking position.

When an unauthorized key is inserted into the barrel lock, the baffle washer and cooperating plunger spring prevent the key from retracting the plunger to its unlocking position. The key central aperture of the baffle washer either prevents the key's fingers from entering the pl unger bore or, if the fingers pass into the plunger bore, the expanding fingers engage the baffle washer and retract only the baffle washer, the plunger spring holding the plunger in its forward locking position.

DESCRIPTION OF THE PREFERRED EMBODIMENT

Figure 1:
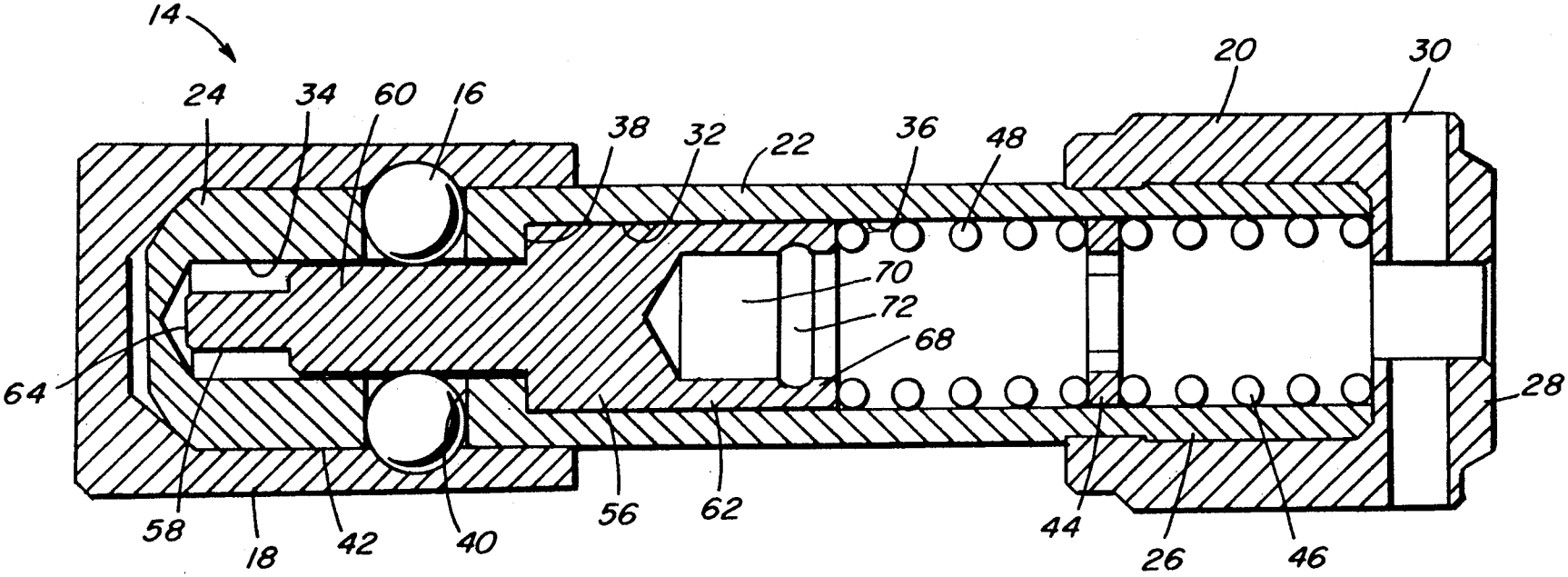
FIG. 1 is a vertical section showing the barrel lock of this invention.

FIG. 1 shows a barrel lock 14 of this invention in its locked condition wherein its two locking members 16, for example locking balls, have been forced radially outward so that they engage a groove in a front end cap 18. Thus, when barrel lock 14 is in its FIG. 1 locked condition, it cannot be longitudinally removed from front end cap 18.

Barrel lock 14 can be used in many situations to lock two elements against various types of relative movement. Front end cap 18 illustrates but one locking situation of the type wherein two unshown apertured flat panels have the lock inserted through both and the two flat panels are prevented from separating by the large rear end cap 20 of the lock on one side and the large front end cap 18 on the other side. There are many other situations in which barrel lock 14 is useful.

Barrel lock 14 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with selected aperture size. A transverse passage 30 is also provided to accommodate a conventional "tell tale" or lead seal used to signal tampering.

The lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends at an angle to the axis of the barrel bore 32. As will be seen, the function of annular shoulder 38 is to act as a plunger stop.

The lock barrel 22 also has two radial ly extending passageways 40 which run from the exterior surface 42 of barrel 22 to the front bore 34 of the barrel. The locking balls 16, for example steel locking balls, are movably mounted in the passageways and are free to move radially within the passageways. At the outer aperture of each passageway, a very small inwardly extending peripheral rim is provided which prevents the locking ball from completely escaping outwardly. However, almost half of the locking ball can project outwardly from the passageway as can be seen from FIG. 1.

Figure 5:
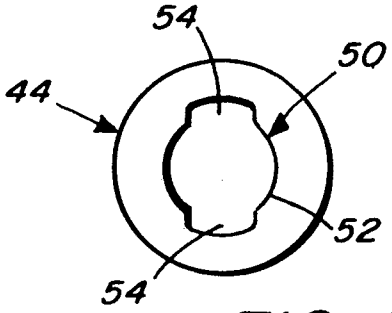
FIG. 5 is an end view of the baffle washer.

A baffle washer 44 is sized and shaped to fit within rear bore 36 of the barrel. Baffle washer 44 is positioned between the front end of a baffle washer compression spring 46 and the rear end of a plunger compression spring 48. Baffle washer compression spring 46 urges the baffle washer towards the front of the lock 14 against pl unger compression spring 48. As shown in FIG. 5, the baffle washer has a central key opening 50. In the illustrated embodiment, by way of example, central opening 50 is a substantially circular opening 52 with diametrically opposite cutouts or slots 54 at its periphery. The shape of central key opening 50 is such that a conventional barrel lock key will not pass through baffle washer 44.

Figure 4:
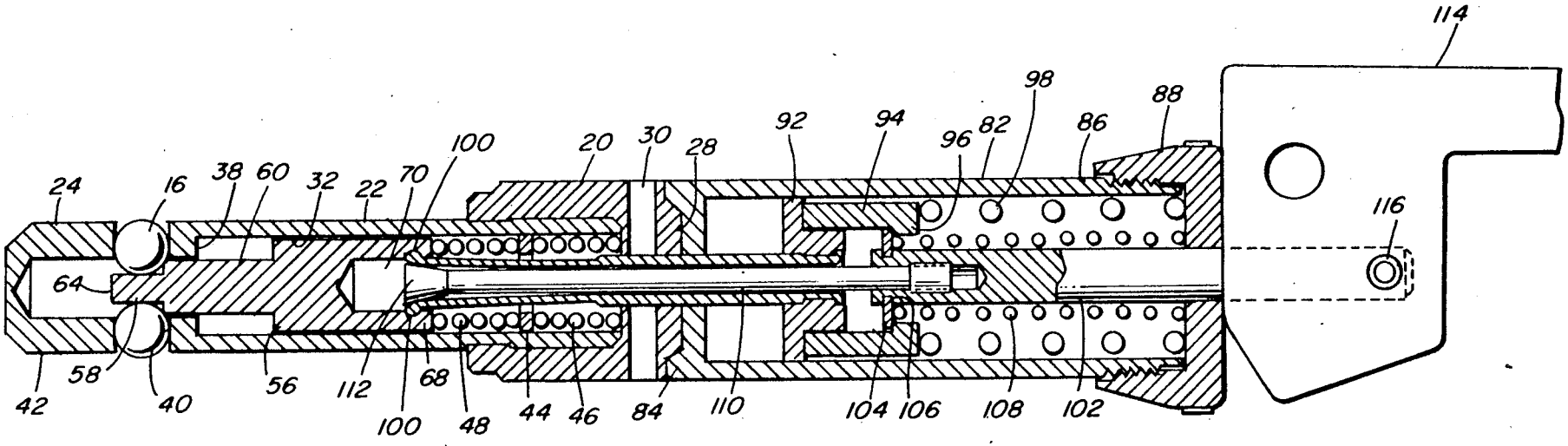
FIG. 4 is similar to FIG. 3 except that the key handle has been pivoted to its final position causing the lock plunger to retract fully. The lock pl unger has cleared the locking passageway inner apertures and the lockin balls have moved radially inward. The unlocked barrel lock has been longitudinally withdrawn from the front end cap to which it was previously secured.

A cylindrical lock plunger 56 is sized, shaped and mounted to reciprocate within the stepped barrel bore 32. The front exterior portion 58 of lock pl unger 56 is sized to permit the locking balls 16 to move radially inward to their unlocking position (FIG. 4). The middle exterior portion 60 of lock plunger 56 slidably fits within the front bore 34 of the barrel 22 and is sized to force the locking balls 16 radially outward to their locking position. The rear exterior portion 62 slidably fits within the rear bore 36 of the barrel 22. The plunger's forward movement is limited by the annular shoulder 38 of barrel bore 32 as shown in FIG. 1. The front end of plunger compression spring 48 bears against the rear portion of lock plunger 56 and continuously urges the lock plunger forwardly. Baffle washer compression spring 46 and plunger compression spring 48 normally are in partially compressed states.

Figure 2:
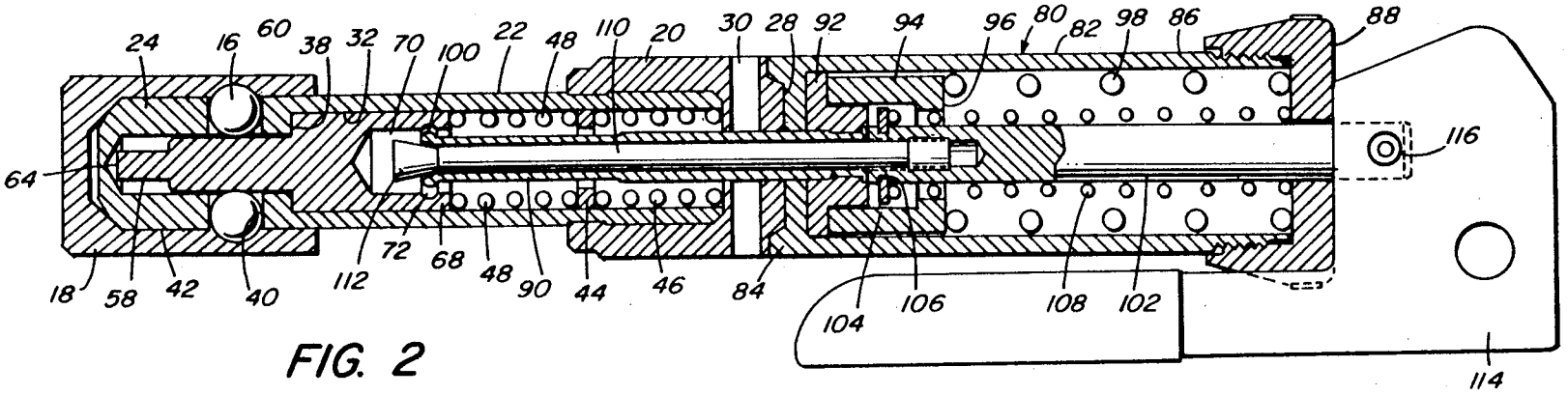
FIG. 2 is a vertical section showing both the barrel lock of FIG. 1 and the key of this invention. The barrel lock is shown in its locked condition, the key shown is inserted into the barrel lock, and the key handle is in its first position.
Figure 3:
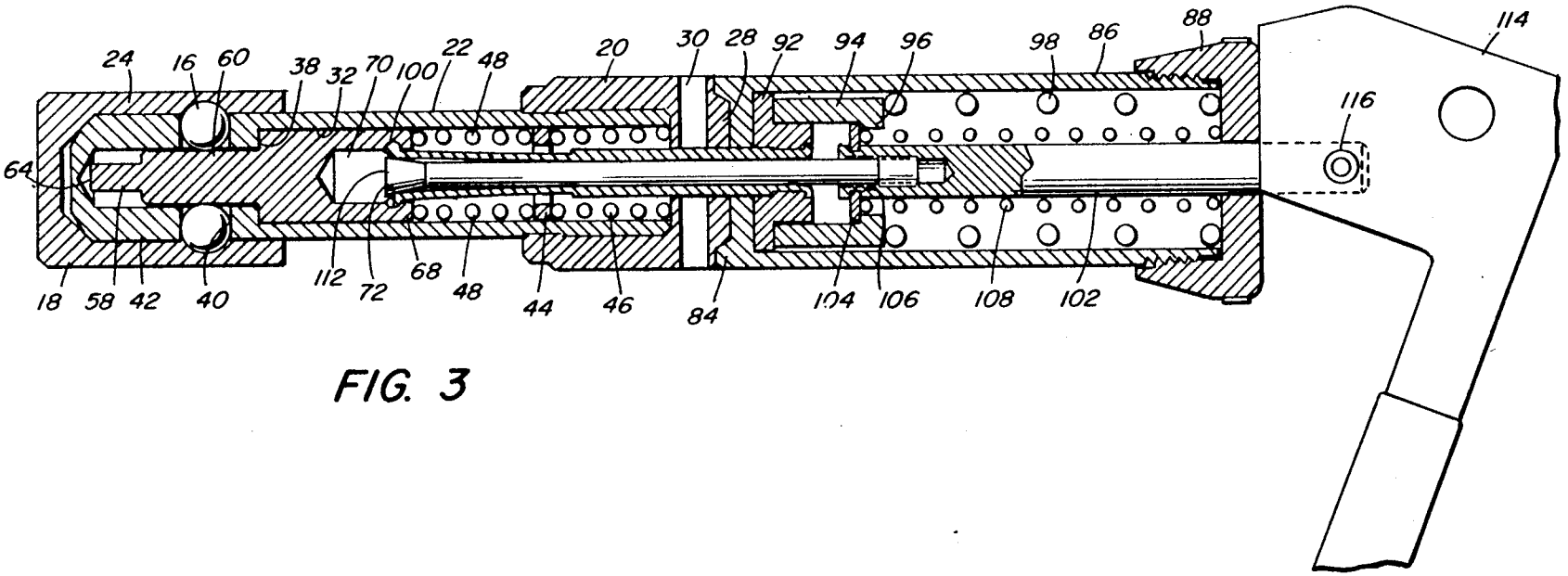
FIG. 3 is similar to FIG. 2 except that the key handle has been pivoted to its second position causing the key's expanding fingers to radia spread and press against the interior surface of the recess in the blind bore in the lock plunger.

The middle exterior portion 60 of the lock plunger 56 moves forwardly across and closes the inner apertures of both locking ball passageways 40 when the lock is in its locked condition as shown in FIGS. 1–3. The lock plunger forces both locking balls 16 radially outward to their locking position whenever the middle portion 60 of the lock plunger cov ers the locking ball passageways 40. However, when the lock pl unger 56 moves rearwardly and front portion 58 is aligned with the passageways 40, the locking balls move radially inward towards the barrel bore 32 as shown in FIG. 4.

The lock plunger 56 has a closed front end 64, an open rear end 68 and an axially extending blind bore 70. The lock plunger 56 also has an annular recess 72 in blind bore 70. The diameter of annular recess 72 is larger than the diameter of the plunger bore 70 and has the function of acting as a gripping surface, as will be subsequently seen. Baffle washer 44 either prevents the fingers of an unauthorized key from entering the blind bore, or, if the fingers enter the blind bore, allows the expanding fingers to engage only the baffle washer and not the gripping surface of the recess in the blind bore.

FIGS. 2–4 show the sequence of unlocking steps produced by movement of the key handle of a key 80 of this invention. FIG. 2 shows key 80 fully inserted through the apertured rear end 28 of the lock barrel 22. Plunger 56 is in its fully forward position against annular shoulder 38 of the barrel 22 and the locking balls 16 are forced radially outward to their locking position. In FIG. 2, the key handle is in its first position and the key 80 is actually not causing any movement of the lock.

FIG. 3 shows the key handle rotated to its second position. The lock has not moved at all, but the key has radially expanded to grip the inner surface of the recess 72 in the blind bore 70.

FIG. 4 shows the key handle rotated to its final position. The lock plunger 56 has been retracted to its rearward position. At this point, the lock becomes unlocked because the plunger middle exterior portion 60 has cleared the inner apertures of passageways 40 and the locking balls 16 are free to move inwardly in the passageways until they contact the plunger front exterior portion 58.

It will be understood from the drawings that if a prior art device, such as a key or a pick or a nail, was inserted in an improper attempt to unlock barrel lock 14 by retracting the lock plunger 56, the key central aperture of the baffle washer 44 will usually block entry into the blind bore 70. If the unauthorized device passes through the key aperture, the baffle washer will prevent gripping of the inner surface of the blind bore because the unauthorized device will expand and grip and carry only the baffle washer 44 rearwardly in bore 36. If baffle washer 44 is pulled rearwardly, plunger compression spring 48 will expand and hold plunger 56 in its forward locking position against shoulder 38. Therefore, middle portion 60 will continue to maintain locking balls 16 in their locking position and the lock will remain locked.

FIGS. 1–4 illustrate the barrel lock 14 which is designed to be locked and unlocked only by the key of this invention. The key 80 will now be described. FIGS. 2–4 show the key 80 in different operating positions. Key 80 has a hollow cylindrical key barrel 82 with an apertured front end 84 and an open rear end 86 which is closed by an aperture cap 88 (creating an apertured rear end).

Two elongated outer expanding fingers 90 extend longitudinally through apertured front end 84 and are fixed at their rear portions to a centrally apertured sleeve bushing 92 which is mounted for axial movement within the bore of key barrel 82 providing a sliding fit therebetween.

Figure 6:
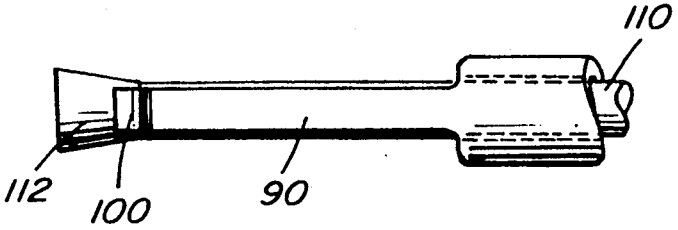
FIG. 6 is a top view of the expanding fingers.

A centrally apertured spacer 94 is positioned to the rear of bushing 92 and has an inwardly extending rear rim 96. An outer coil spring 98 is positioned between rear rim 96 and key barrel rear end cap 88 and urges bushing 92 and expanding fingers 90 forwardly. The expanding fingers 90 are formed by slabbing or cutting away the sides of a hollow cyclinder as shown in FIG. 6. The rear end of the cylinder is fixed to bushing 92 and the tips 100 of the expanding fingers 90 are substantially thickened to provide good gripping surfaces. The fingers 90 are radially spreadable and the finger tips 100 are designed to be spread into a gripping relationship with the interior surface of such as the recess 72 within lock plunger blind bore 70. However, the fingers 90, the finger tips 100, and the baffle washer key central aperture 50 are all sized and shaped so that fingers 90 can be spread and finger tips 100 can grip recess 72.

To the rear of bushing 92, a key plunger 102 is coaxially movably mounted within key barrel 82. Key plunger 102 extends rearwardly through apertured rear end cap 88 of barrel 84. The front end of plunger 102 abuts bushing 92. A retaining ring 104 is received in a groove 106 in the front end of plunger 102. An inner coil spring 108 is mounted around key plunger 102. The front end of spring 108 bears against the rear surface of retaining ring 104. The rear end of spring 108 bears against the front surface of end cap 88 and keeps the plunger 102 urged forwardly. Both outer compression spring 98 and inner compression spring 108 are normally in partially compressed states.

A cylindrical expander rod 110 is telescopically and slidably mounted within the center of the outer expanding fingers 90. Expander rod 110 has a frusto-conical front end 112 which has its maximum diameter at the front. The rear end of expander rod 110 is fixed to key plunger 102 and passes through the apertured front end 84 of the barrel 82 and the bushing 92. The length of the expander rod 110 is greater than the length of the expanding fingers 90. As shown in FIG. 6, the distance between the slabbed sides of expanding fingers 90 is narrower than the diameter of expander rod 110. A key handle 114 is pivotally attached to the rear end of plunger 102 by a pivot pin 116. Key handle 114 is shaped to be rotated in order to progressively retract key plunger 102 and its associated key parts.

FIG. 2 shows key handle 114 in its first position with plunger 102 in its forward position in contact with bushing 92. Expander rod 110 is in its forward position and the expander rod front end 112 is projected forward of finger tips 100. Thus, finger tips 100 are not spread at all and do not grip the recess 72 in the blind bore 70 of lock plunger 56. In the first position, the key 80 has not acted on the lock at all and the lock remains in its locked condition.

FIG. 3 shows the key handle 114 rotated to its second position. Plunger 102 has retracted a small distance out of contact with bushing 92. Although plunger 102 has retracted, outer coil spring 98 holds spacer 94 forward which, in turn, holds bushing 92 and expanding fingers 90 forward. On the other hand, the retracting key plunger 102 pulls expander rod 110 rearwardly so that the expander rod frusto-conical front end 112, which has a larger outer diameter than the inner diameter of the expanding fingers 90, is retracted to the same axial position as the finger tips 100 causing the fingers and finger tips to spread apart radially. Outer coil spring 98 maintains continuous forward axial pressure against fingers 90 resisting their retraction, and expander rod 110 generates continuous rearward axial and radial pressures against the interior of the expanding finger tips 100. Consequently, the finger tips 100 spread radially outward without retracting, thereby causing the tips to grip the interior surface of the recess 72 in the lock plunger rear bore 70 with substantial force. The fingers 90 are radially spread apart a distance which is sufficient to firmly urge the finger tips 100 into gripping contact with recess 72.

FIG. 4 shows the key handl e 114 rotated to its final position. The key plunger 102 has been retracted to a rearward position. Retaining ring 104, which is fixed to plunger 102, also has been retracted. Expander rod 110, which is fixed to key plunger 102, has been retracted. The expanding fingers 90 are retracted by rearward movement of expander rod 110. Spacer 94 limits independent axial movement of expander rod 110 with respect to the axial movement of expanding fingers 90 to protect the expanding fingers from being over stressed. The lock plunger 56 has been retracted by the retracting fingers 90. The radial clamping force provided by the expanding fingers 90 is dependent upon the axial force transmitted from the outer spring 98 through spacer 94 to bushing 92. Middle portion 60 has been retracted clear of the passageways 40, permitting the locking balls to move inwardly and the lock to become unlocked and removed from front end cap 18.

The above description obviously suggests many possible variations and modifications of this invention which would not depart from its spirit and scope. It should be understood, therefore, that the invention is not limited in its application to the details of the structure specifically described or illustrated and that, within the scope of the appended claims, it may be practiced otherwise than as specifically described or illustrated.

What is claimed is:

1. In a conventional barrel lock including:

(a) a hollow cylindrical lock barrel having a closed front end and an apertured rear end, said lcok barrel having a stepped axially extending bore, a front bore of said stepped bore having a relatively small diameter and a rear bore of said stepped bore having a relatively large diameter;

(b) said stepped barrel bore having an annular shoulder forming the junction between said front bore and said rear bore;

(c) at least two radially extending passageways running from an outer aperture in the exterior surface of said lcok barrel to an inner aperture in said front bore of siad lock barrel, and a locking member mounted in each said passageway for limited movement therein, said lcoking member restrained from completely escaping through said outer aperture;

(d) a cylindrical plunger having a stepped axially extending exterior surface sized and shaped to slidably fit and reciprocate within said stepped bore of said lcok barrel, the forward movement of said plunger being limited by said barrel bore annular shoulder, the front exterior portion of said plunger being sized and shaped to permit said locking members to move radially inwardly, the middle exterior portion of said plunger being sized and shaped to prevent said locking members from moving radially inwardly, said plunger in its rearward position opening the inner aperture of each said passageway and permitting each said locking member to move radially inwardly to its unlocking position, said plunger in its forward position closing the inner aperture of each said passageway and forcing each said lcoking member outwardly to its locking position;

(e) said plunger having a rearwardly facing annular rear end surface and an axially extending blind bore opening at said plunger rear end surface;

(f) said blind bore haivng an annular recess adjacent to and forward of said rear end surface of said plunger, said annular recess acting as a gripping surface; and (g) a baffle washer having a central key opening positioned loosely in said rear barrel bore, said central opeing being a non-circular opening through which a conventional expanding key having a circular profile cannot be inserted, the improvement in said barrel lock comprising:

(h) a plunger compression spring positioned in said rear barrel bore entirely to the rear of and in contact with said rearwardly facing rear end surface of said plunger, the front end of said plunger compression spring bearing against said rearwardly facing rear end surface of said plunger and urging said plunger forwardly; and (i) a baffle compression spring positioned in said rear barrel bore to the rear of said plunger compression spring, the rear end of said baffle compression spring bearing against the rear end of said lock barrel;

(j) the rear end of said plunger compression spring and the front end of said baffle compression spring bearing directly against the opposite sides of said baffle washer to respectively exert rearwardly and forwardly directed forces spring-biasing said baffle washer in a floating position which is always spaced from and between said rearwardly facing plunger rear end surface and said rear end of said lock barrel, said plunger compression spring being yieldably responsive to an external forwardly directed force exerted on said baffle washer in addition to the forwardly directed force exerted by said baffle compression spring to accommodate forward movement of said baffle washer from said floating position towards said plunger;

(k) the operation of an expanding key having a profile identical to said non-circular opening in said baffle washer inserted in said lock and passed through said key opening in said baffle washer gripping said recess and causing tsaid plunger to be drawn rearwardly permitting said locking members to move to their inward unlocking position, and the operation of an expanding key having a profile different from said non-circular opening in said baffle washer inserted in said lock being prevented by said baffle washer from passing through said key opening in said baffle washer and therefore from drawing said plunger rearwardly.

2. The barrel lock as claimed in claim 1 wherein said central key opening is a substantially circular opening with at least one radially extending cutout along its periphery.

3. The barrel lock as claimed in claim 2 wherein said central key opening is a substantially circular opening with diametrically opposite radially extending cutouts along its periphery.

4. The barrel lock as claimed in claim 1 wherein said plunger compression spring and said baffle compression springs are partial ly compressed, said plunger compression spring urging said plunger forward.

* * * * *